US008544148B2

(12) United States Patent
Keishold

(10) Patent No.: US 8,544,148 B2
(45) Date of Patent: Oct. 1, 2013

(54) TRAVERSE ROD SYSTEM

(75) Inventor: Karl Siegfried Keishold, Boulder, CO (US)

(73) Assignee: Ona Drapery Hardware, Boulder, CO (US)

( * ) Notice: Subject to any disclaimer, the term of this patent is extended or adjusted under 35 U.S.C. 154(b) by 413 days.

(21) Appl. No.: 12/759,538

(22) Filed: Apr. 13, 2010

(65) Prior Publication Data

US 2011/0247174 A1 Oct. 13, 2011

(51) Int. Cl.
*A47H 13/02* (2006.01)

(52) U.S. Cl.
USPC ..... 16/87.4 R; 160/346

(58) Field of Classification Search
USPC ..... 16/87 R, 87.2, 87.4 R, 87.6 R, 87.6 W, 16/87.4 W, 87.8, 94 R, 94 D, 95 R, 95 W, 16/95 D, 95 DW, 96 R, 96 D, 96 L; 160/345, 160/346, 347, 126
See application file for complete search history.

(56) References Cited

U.S. PATENT DOCUMENTS

| | | | | | |
|---|---|---|---|---|---|
| 592,795 | A | | 11/1897 | Leslie | |
| 1,662,928 | A | | 3/1928 | Kirsch | |
| 2,528,848 | A | * | 11/1950 | Weinzimmer | 16/87.6 R |
| 3,315,297 | A | * | 4/1967 | Bender | 16/87.8 |
| 3,354,498 | A | * | 11/1967 | Salzmann | 16/87.4 R |
| 4,141,105 | A | | 2/1979 | Gonon | |
| 4,190,927 | A | | 3/1980 | Hepperle | |
| 4,402,109 | A | * | 9/1983 | Ohman et al. | 16/95 D |
| 5,031,257 | A | * | 7/1991 | Jeffery | 16/94 D |
| 5,355,551 | A | * | 10/1994 | Schechter et al. | 16/87.2 |
| 5,542,149 | A | * | 8/1996 | Yu | 16/87.4 R |
| 6,138,324 | A | | 10/2000 | Lin | |
| 6,308,387 | B1 | * | 10/2001 | Borzi | 16/87.2 |
| 6,499,708 | B1 | | 12/2002 | Cowen | |
| 7,137,171 | B2 | | 11/2006 | Meech et al. | |
| 2008/0148526 | A1 | * | 6/2008 | Garcia | 16/87 R |

* cited by examiner

*Primary Examiner* — Jeffrey O'Brien
(74) *Attorney, Agent, or Firm* — Marsh Fischmann & Breyfogle LLP; Kent A. Fischmann

(57) ABSTRACT

A traverse rod system for manipulating one or more hanging objects is provided. The traverse rod system includes a hollow longitudinally extending tube having an opening that extends along an upper length of the tube as well as a number of rings that at least partially encircle the tube and that are directly or indirectly coupled with one or more hanging objects. A cord is suspended within the tube and secured by one or more cord carriers, each having a top portion that attaches to one of the rings and a bottom portion that is freely suspended through the opening and into the hollow tube such that other than the cord and the cord carriers, an interior of the hollow tube remains substantially free of structure relating to the traverse rod system. Movement of the cord causes the cord carriers to traverse an interior of the tube while the attached rings traverse an exterior of the tube. As a result, the hanging object(s) move in connection with the cord and the cord carriers in a desired direction or directions.

24 Claims, 5 Drawing Sheets

TRAVERSE ROD SYSTEM

FIELD OF THE INVENTION

This invention relates to traverse rods in general and, more particularly, to a simplified traverse rod system for manipulating hanging objects.

BACKGROUND OF THE INVENTION

Traverse rods (e.g., curtain rods) are generally designed to support and manipulate hanging objects such as curtains, drapes, window coverings, wall coverings, or any other hanging objects relative to a span of a window, wall, or ceiling. Because oftentimes traverse rods are incorporated into a room's décor, traverse rods often include various aesthetic features such as painted colors or designs, embossments, stenciling, plating, veneering, or other surface enhancement. Traverse rods may also include decorative end caps and/or finials at their ends to further enhance aesthetic appeal.

To facilitate manipulation of objects hanging from a traverse rod, a traverse rod often exists as part of a larger traverse rod system that allows a user to manipulate the hanging objects without directly touching the hanging objects themselves. Traverse rod systems generally include a cord that is secured to one or more master carriers positioned along a longitudinal span of the traverse rod. The master carriers as well as numerous subordinate carriers are affixed to rings that either completely or partially encircle the traverse rod. In turn, the rings directly or indirectly couple with the one or more hanging objects. When the cord is moved in one direction or another, the master carriers and their associated rings traverse the traverse rod, either pushing or pulling the subordinate carriers and their associated rings such that the hanging objects move between open and closed positions. The cord, the master and subordinate carriers, and the rings may be configured to achieve a desired manipulation of the hanging objects, including, for example, a single-direction open-and-close operation or a dual-direction open-and-close operation in which the hanging objects open from the center outward towards opposing ends of the traverse rod.

Because the traverse rod is itself aesthetically significant, there have been attempts to conceal the less attractive cord and carriers behind, within, or partially within the traverse rod in order to improve the appearance of the rod. In this regard, some traverse rods include tracks along a top or a back side of the rod. The master and subordinate carriers run along the track and are at least partially concealed from view. In order to prevent interference between the rings and the traverse rod, which can erode the aesthetically appealing surface of the traverse rod over time, the track and the carriers are generally configured to support the rings at a distance from the rod such that when the carriers travel along the track, the rings traverse the rod without contacting or resting upon any portion of the traverse rod.

This approach requires a more intricate traverse rod in which a supporting track for the master and subordinate carriers must be formed or inserted within or behind the rod, thereby increasing the time and cost associated with manufacturing the traverse rod system. In addition, because the rings are held a distance apart from the traverse rod, generally all of the rings must be associated with a carrier or some other type of buttressing structure, thereby increasing the complexity and number of parts required of the traverse rod system since each of the rings is directly supported by something other than the traverse rod itself. Moreover, because this approach can result in a busy or disorderly appearance, conventional traverse rods are often placed within separately manufactured outer rods or fascias such as, for example, external wooden rods that have been routed out. This approach conceals the workings of the less attractive traverse rods within, but adds even greater complexity to the system and requires manufacturers of traverse rod systems to obtain parts from additional suppliers.

SUMMARY OF THE INVENTION

The present invention relates to an aesthetically appealing traverse rod system for drawing or manipulating hanging objects such as, for instance, curtains, drapes, window coverings, wall coverings, tapestries, and the like. The inventors have recognized that existing traverse rod systems are deficient in many meaningful ways and that there is a need for a simplified traverse rod system in which an exterior of the traverse rod directly supports one or more rings either partially or fully encircling the traverse rod, thereby relieving the need concealing fascias or for internal tracks within the traverse rod as well as a number of additional supporting or buttressing structures that serve to hold the rings a distance apart from an exterior of the traverse rod.

In particular, a first aspect of the present invention includes a traverse rod system that includes a longitudinally extending tube and one or more rings at least partially encircling the tube. The tube includes an opening that extends along an upper length of the tube. The traverse rod system also includes a cord carrier that is freely suspended from the rings into the tube through the opening. The cord carrier secures a portion of a cord such that when the cord moves relative to an interior of the tube, the rings traverse an exterior of the tube.

The tube, the rings, and the cord carrier may be formed of any appropriate material including, for example, metal (e.g., steel or aluminum), plastic, or wood. In addition, the tube may be any appropriate length or diameter, and the number and/or diameter of the rings may be sufficient to accommodate the length and/or diameter of the tube. In addition, the tube may be a hollow member or it may be a solid member having an inset channel that defines the opening that extends along the upper length of the tube. In addition, the rings may rest directly upon the upper length of the tube such that they slide along the upper length of the tube when the traverse rod system is in operation. To ease the sliding motion between the upper length of the tube and the rings, the rings may include a low-friction lining about their inner diameters. This lining may be formed of any appropriate material such as, for instance, a clear thermoplastic polymer.

The tube may also include a number of decorative features such as painted colors or designs, embossments, stenciling, plating, veneering, or other surface enhancements. In one implementation, the tube may also have a curvature. For instance, the tube may be curved outward away from an associated surface (e.g., a wall, a window, etc.). The level of curvature or radius of curvature may be a function of the diameter of the tube and/or a configuration of the cord carrier (e.g., a length, a shape, a thickness of the cord carrier).

The tube may also include first and second longitudinal edges that border first and second sides of the opening, respectively. In one implementation, one or more edge guards may be associated with each of the first and second longitudinal edges. The edge guards may be formed of any appropriate material and may be configured to envelop each of the first and second longitudinal edges of the tube. Thus, in one embodiment, the rings may rest or bear upon the edge guards such that they do not slide or rub directly against the upper surface of the tube when traversing the tube.

The traverse rod system may also include a pulley mechanism that is affixed within each end of the tube such that the cord may be tensioned or suspended between the two pulley mechanisms in a manner that allows the cord to circulate within the interior of the tube. Each of the pulley mechanisms may include one or more roller bearings that are operably coupled to a pulley housing. When the cord moves relative to the interior of the tube, the cord carrier that secures a portion of the cord may also move relative to the interior of the tube, causing the rings that are attached to the cord carrier to traverse the exterior of the tube.

In another implementation, the traverse rod system may also include an object carrier coupled to each of the rings. The object carriers may be configured to engage a hanging object or objects such that when the rings traverse the exterior of the tube, the object carriers and associated hanging objects also traverse the exterior of the tube. The object carriers may be any appropriate structure capable of coupling the hanging objects to the rings.

Another aspect of the present invention provides a traverse rod system that includes a longitudinally extending tube having a tube exterior, a tube interior, and an opening that extends along an upper length of the tube. The traverse rod system also includes a first ring that at least partially encircles the tube and rests upon a bearing surface of the tube exterior, a cord suspended within the hollow tube interior, and a first cord carrier that is fixably coupled to the first ring and extends into the hollow tube interior. The cord has a first portion and a second portion, and the cord carrier secures the first portion of the cord such that when the first cord portion moves in a first direction relative to the tube interior, the first ring moves in the first direction relative to the tube exterior.

The longitudinally extending tube may include first and second longitudinal edges bordering first and second sides of the opening, and in one implementation, the bearing surface of the tube exterior may include one or more edge guards that envelop each of the first and second longitudinal edges. In this embodiment, the rings may bear upon the edge guards rather than directly upon the tube exterior, thereby protecting the tube exterior from wear during operation of the traverse rod system. In another embodiment, inner diameters of the rings may include low-friction linings to achieve a similar purpose.

In another implementation, the first cord carrier may be freely suspended from the first ring into the hollow tube interior. In addition, the cord may be suspended between a first pulley mechanism affixed at a first end of the hollow tube interior and a second pulley mechanism affixed at a second end of the hollow tube interior such that the cord may circulate within the hollow tube interior. Moreover, each of the first and second pulley mechanisms may comprise one or more roller bearings that are operably coupled to a pulley housing. Specifically, the first and second pulley mechanisms may be configured such that when the first portion of the cord moves in the first direction relative to the tube interior, the second portion of the cord moves in a second direction relative to the tube interior. The first and second directions may be opposite directions. Further, when the first portion of the cord moves relative to the hollow tube interior, the first cord carrier also moves relative to the hollow tube interior and, in turn, the first ring traverses the tube exterior.

In yet another embodiment, the traverse rod system may also include a second ring at least partially encircling the tube and a second cord carrier that is fixably coupled to the second ring and that extends through the opening and into the hollow tube interior. The second ring may rest upon the bearing surface of the tube exterior, and the second cord carrier may secure the second portion of the cord such that when the first portion of the cord moves in the first direction, the second ring traverses the tube exterior in the second direction.

In addition, one embodiment of the traverse rod system may include first and second object carriers that are fixably coupled to the first and second rings. The first and second object carriers may be configured to engage first and second hanging objects such that when the first portion of the cord moves in the first direction, the first and second hanging objects move in the first and second directions, respectively. To ensure that the first and second hanging objects close fully, the first object carrier may include a first overlap arm and the second object carrier may include a second overlap arm. The first and second overlap arms may be configured to overlap when the first and second cord carriers are positioned at an approximate midpoint along the tube.

As discussed above, the longitudinally extending tube, the first and second rings, the first and second cord carriers, and the first and second object carriers may be formed of any appropriate material(s) including, for example, metal (e.g., steel or aluminum) or plastic. In addition, the longitudinally extending tube may have any appropriate length or diameter, and the first and second the rings may be configured to accommodate the diameter of the tube. The tube may also include a number of decorative features and, in one implementation, the tube may have a curvature. The radius of curvature may be a function of various system parameters including, for example, the diameter of the tube and/or a configuration of the cord carrier (e.g., a length, a shape, a thickness).

Yet another aspect of the present invention provides a traverse system for manipulating hanging objects. The traverse system includes a rod, one or more rings at least partially encircling the rod, a cord carrier coupled with the rings, and a cord that is longitudinally suspended within an interior of the rod. The rod includes first and second end portions bordering a longitudinally extending center portion. In addition, the rod has an inner annular wall that is uniformly offset from an outer annular wall and an opening extending along an upper length of the cylinder. The cord is fixably attached to the cord carrier such that moving the cord relative to the rod moves the rings relative to the rod. Other than the cord carrier and the cord, the interior of the longitudinally extending center portion of the rod is substantially free of structure relating to the traverse rod system.

In one embodiment, the outer annular wall comprises a bearing surface that supports the rings. In another embodiment, the cylinder has first and second edges bordering the opening, and the bearing surface comprises one or more edge guards that envelop each of the first and second edges.

BRIEF DESCRIPTION OF THE DRAWINGS

For a more complete understanding of the present invention and further advantages thereof, reference is now made to the following Detailed Description taken in conjunction with the accompanying drawings, wherein.

DETAILED DESCRIPTION OF THE INVENTION

The following description describes exemplary embodiments of a traverse rod system. Specifically, the description details embodiments of a traverse rod system for drawing or manipulating one or more hanging objects (e.g., curtain panels, drapery panels, window coverings, wall coverings, tapestries, and any other hanging objects) along a traverse rod. The following description should be understood as exemplifying the invention without limiting it. In addition, while various embodiments of the present invention have been described in detail, it is apparent that further modifications and adaptations of the invention will occur to those skilled in the art.

Unfortunately, many traverse rod systems with improved aesthetics exhibit several disadvantages. For example, in an effort to prevent damage to aesthetically appealing traverse rods, existing traverse rod systems employ carriers that slide along tracks that are built into the traverse rods. Full or partial rings are attached to the carriers, and the tracks and/or the carriers are configured to hold each of the rings at a distance from the traverse rod as the rings traverse a length of the traverse rod. In addition, existing traverse rod systems have an inner traverse rod and an outer fascia, each supplied by a different source. As discussed above, these systems are complex and expensive to manufacture in that they require specialized machining or other manufacturing techniques and a cumbersome number of outsourced parts.

Generally, the traverse rod system described below includes a cord-drawn system that fully conceals system mechanics within the traverse rod using a simple, elegant design in which the rings bear upon the rod itself without wearing or damaging a surface of the traverse rod. Because the rings bear directly upon the traverse rod, the rod does not require any type of track to support structures that hold the rings apart from the traverse rod, thereby simplifying the system and reducing the number of requisite parts.

Figure 1:
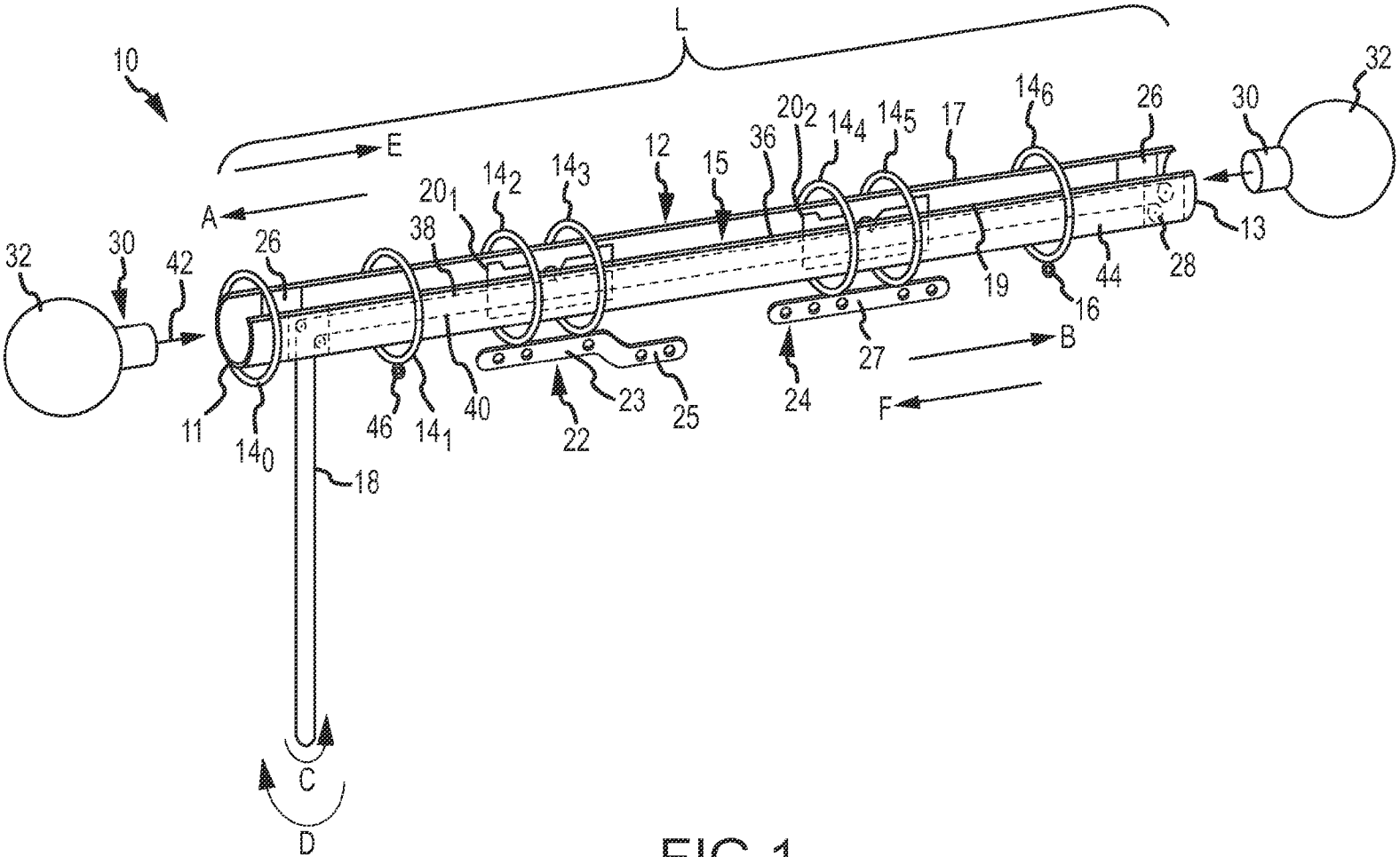
FIG. 1 shows a front perspective view of one embodiment of a traverse rod system.

In one embodiment shown in FIG. 1, a traverse rod system 10 includes a traverse rod formed of a tube 12 that extends longitudinally from a first end 11 of the tube 12 to a second end 13 of the tube 12. The tube 12 also includes an opening 15 that extends between the first and second ends 11, 13 along a length, L, of the tube 12. The opening 15 is bordered by a first longitudinal edge 17 and a second longitudinal edge 19 of the tube 12. The tube 12 may be a hollow member as shown in FIG. 1. In another embodiment, the tube 12 may be a solid member having an inset channel (not shown) that defines the opening 15 and that extends along the upper length of the tube 12. In this embodiment, the inset channel may optionally be lined with any appropriate material such as, for instance, aluminum or plastic.

Figure 6:
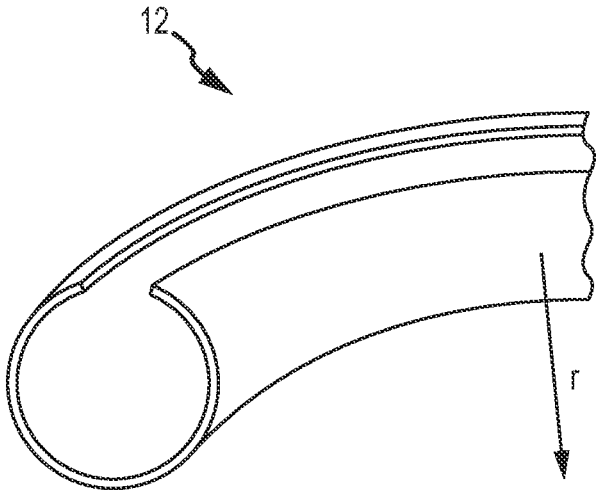
FIG. 6 shows a perspective view of a curved embodiment of a traverse rod for use in the traverse rod system of FIG. 1.

The tube 12 may have any appropriate length and diameter dimensions necessary to span a desired distance and/or to support the weight of a desired hanging object. In addition, the tube 12 may be formed of any appropriate material including, for instance, metal (e.g., steel, aluminum, etc.), plastic, or wood. The opening 15 may be a machined slot or it may be formed as part of a manufacturing process associated with the tube 12 (e.g., extrusion, injection molding or die casting). The tube 12 may also include various desirable aesthetic features. For instance, a pattern may be painted or embossed upon the tube 12 or the tube 12 may be covered with fabric, appliqués, texturing, plating, veneering, or the like. In another example shown in FIG. 6, the tube may be curved to fit a desired space or to achieve a desired visual appearance. Given the relative simplicity of the traverse rod system 10, as discussed further below, the tube may have a small radius of curvature, r, without interfering with the proper operation of the traverse rod system 10. The radius of curvature, r, may be a function of the diameter of the tube 12 and/or a configuration (e.g., a length, a shape, a thickness) of one or more cord carriers 20 disposed within the tube 12. The cord carriers 20 are discussed in detail below.

In this embodiment, several rings $\mathbf{14}_{0\text{-}6}$ encircle the tube 12. While the rings $\mathbf{14}_{0\text{-}6}$ shown in FIG. 1 completely encircle the tube 12, the rings may also partially encircle the tube 12 in any appropriate or desired manner (e.g., C-rings). Each of the rings $\mathbf{14}_{0\text{-}6}$ may be coupled with a hanging object 50 (FIG. 3) in any appropriate manner including the use of one or more separate object carriers that are coupled between the rings $\mathbf{14}_{0\text{-}6}$ and the hanging object 50. For example, in the embodiment shown in FIG. 1, the ring $\mathbf{14}_1$ may be coupled to the hanging object 50 using an eyelet 46 for attachment to the top of the hanging object 50. In addition, the rings $\mathbf{14}_{2\text{-}3\ and\ 4\text{-}5}$ may attach to first and second object carriers 22, 24, respectively, to ensure that separate panels of the hanging objects 50 may meet or overlap when the hanging objects 50 are moved into a closed position at a midpoint along the length, L, of the tube 12. For example, the first object carrier 22 is attached to the rings $\mathbf{14}_{2\text{-}3}$ and includes a base portion 23 and an overlap arm 25. The second object carrier 24 is attached to the rings $\mathbf{14}_{4\text{-}5}$ and includes an extended overlap arm 27. The overlap arm 25 of the first object carrier 22 is offset from the base portion 23 such that it overlaps with the extended overlap arm 27 of the second object carrier 24 when the first and second object carriers 22, 24 meet, thus ensuring that the hanging objects 50 associated with the first and second object carriers 22, 24 can be fully closed. In addition, while FIG. 1 shows six rings $\mathbf{14}_{1\text{-}6}$, it should be understood that any appropriate number of rings may be used depending on the length, L, of the tube 12, the weight of the hanging objects 50, a desired appearance, and so on.

Figure 2:
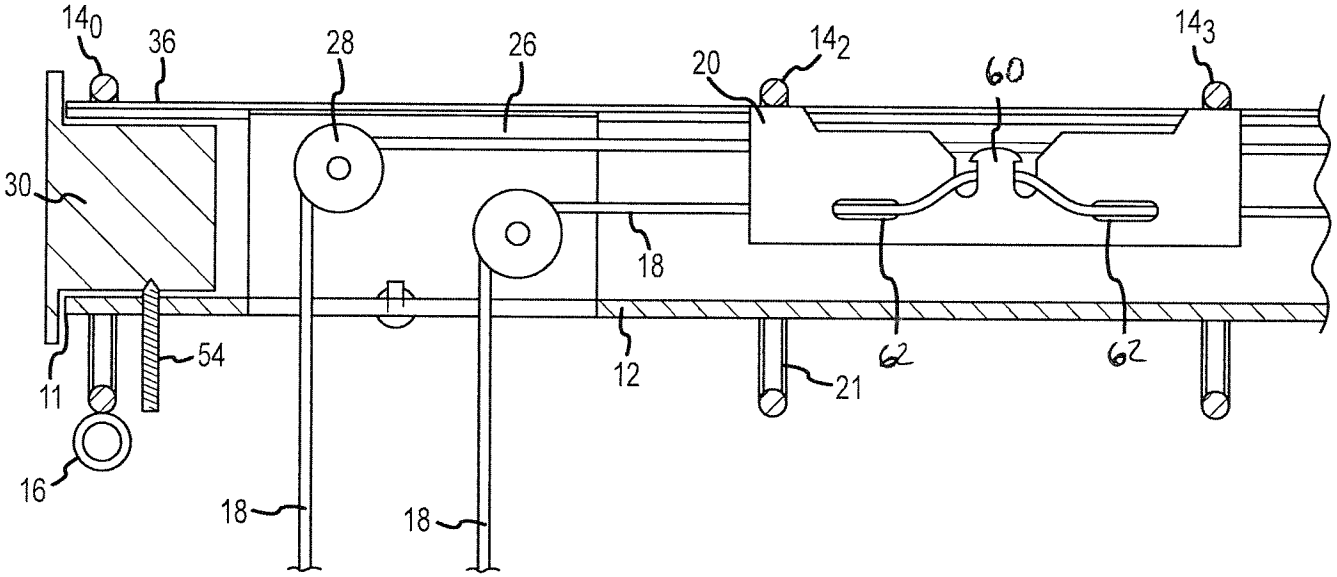
FIG. 2 shows a front cross-sectional view of a portion of the traverse rod system of FIG. 1.
Figure 3:
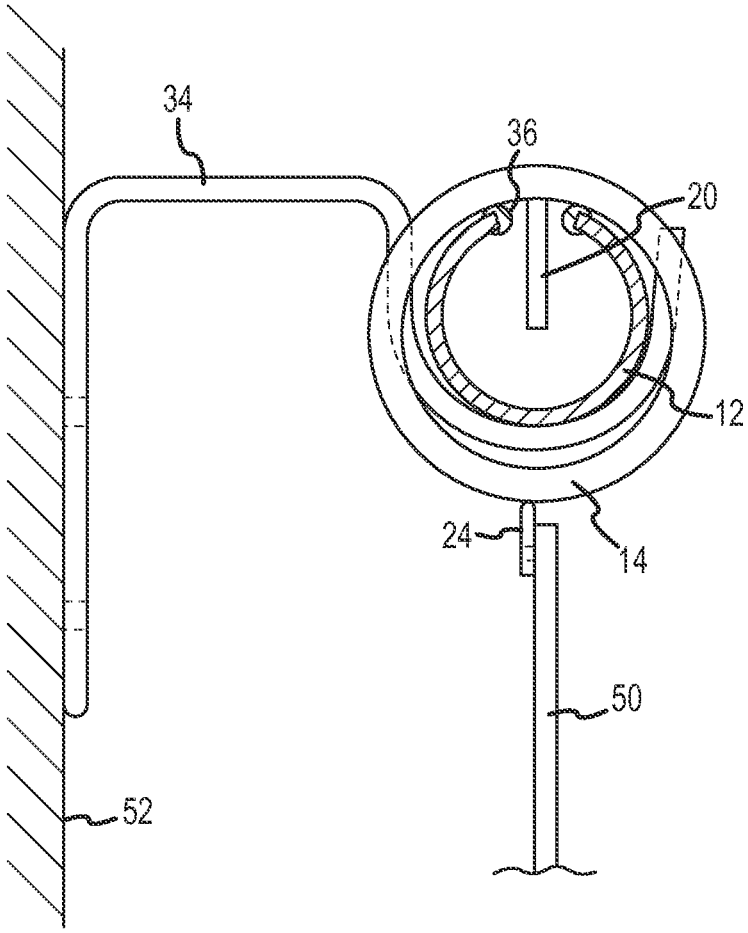
FIG. 3 shows an end view of select components of the traverse rod system of FIG. 1 supporting a hanging object, where the traverse rod system is mounted via a bracket.

The first and second longitudinal edges 17, 19 of the tube 12 may form a bearing surface upon which the rings $\mathbf{14}_{0\text{-}6}$ may rest, as shown in FIG. 1. In this regard, the rings $\mathbf{14}_{0\text{-}6}$ may slide freely along the length, L, of the tube 12, without any additional supporting structure. In one embodiment, one or more edge guards 36 may envelop each of the first and second edges 17, 19, as shown in FIGS. 2-3. The edge guards 36 create a smooth, low-friction bearing surface upon which the rings $\mathbf{14}_{0\text{-}6}$ may glide, thereby protecting the tube 12 against damage from protracted use. Alternatively or additionally, one or more of the rings $\mathbf{14}_{0\text{-}6}$ may include a low-friction ring lining 21, as shown in FIG. 2. In each of these embodiments, the tube 12 provides the sole physical support for the rings $\mathbf{14}_{0\text{-}6}$, which directly or indirectly rest upon the first and second longitudinal edges 17, 19 of the tube 12.

The edge guards 36 and/or the ring linings 21 may be formed of any appropriate low-friction material. For example, in one embodiment, the edge guards 36 and/or the ring linings 21 may be formed of a clear thermoplastic polymer such as polyvinyl chloride (PVC). In other embodiments, the edge guards 36 and/or the ring linings 21 may be tinted or colored to further enhance the aesthetics of the traverse rod system 10.

The edge guards 36 may be applied to the first and second longitudinal edges 17, 19 in any appropriate manner. For example, the edge guards 36 may have an adhesive backing, may be press fit onto the first and second longitudinal edges 17, 19, or they may be adhered to the first and second longitudinal edges 17, 19 using a separate adhesive (e.g., a spray adhesive). Similarly, the ring linings 21 may be applied to the rings 14 in any appropriate manner.

A number of cord carriers 20 may be attached to one or more of the rings $\mathbf{14}_{0\text{-}6}$. For instance, in the embodiment shown in FIG. 1, cord carriers $\mathbf{20}_{1,\,2}$ are attached to the rings $\mathbf{14}_{2\text{-}3\ and\ 4\text{-}5}$, respectively. The cord carriers $\mathbf{20}_{1,\,2}$ are freely suspended from the attached rings $\mathbf{14}_{2\text{-}3\ and\ 4\text{-}5}$ and extend through the opening 15 into an interior 42 of tube 12, where the cord carriers $\mathbf{20}_{1,\,2}$ may each secure a portion of a cord 18. Thus, when a user moves the cord 18 in one direction or another, each of the carriers $\mathbf{20}_{1,\,2}$ move with the cord 18 and traverse the interior 42 of the tube 12. In turn, the attached rings $\mathbf{14}_{2\text{-}3\ and\ 4\text{-}5}$ traverse an exterior 44 of the tube 12.

For example, in the embodiment shown in FIG. 1, the cord carrier $\mathbf{20}_1$ secures a first portion 38 of the cord 18 and is attached to the rings $\mathbf{14}_{2\text{-}3}$. The cord carrier $\mathbf{20}_2$ secures a second portion 40 of the cord 18 and is attached the rings $\mathbf{14}_{4\text{-}5}$. The rings $\mathbf{14}_{2\text{-}3\ and\ 4\text{-}5}$ are centered relative to the remaining rings $\mathbf{14}_{1,\,6}$. As a result, when a user moves the cord 18 in a counter-clockwise direction denoted by an arrow C, the first portion 38 of the cord 18 moves in the direction of arrow A, and the second portion 40 of the cord 18 moves in the direction of arrow B, thereby causing the rings $\mathbf{14}_{2\text{-}3}$ and $\mathbf{14}_{4\text{-}5}$ to move in the directions of arrows A and B, respectively. As the rings $\mathbf{14}_{2\text{-}3}$ and $\mathbf{14}_{4\text{-}5}$ traverse the rod 12, they contact and advance the remaining rings $\mathbf{14}_1$ and $\mathbf{14}_6$, which remain unattached to any type of carrier. The hanging objects 50 that are coupled with the rings $\mathbf{14}_{0\text{-}6}$ follow the movement of the rings $\mathbf{14}_{0\text{-}6}$ into an open position.

In reverse, the user may move the cord 18 in a clockwise direction denoted by an arrow D. In response, the first portion 38 of the cord 18 moves in the direction of arrow E, and the second portion 40 of the cord 18 moves in the direction of arrow F. This, in turn, moves the cord carrier $\mathbf{20}_1$ as well as the attached rings $\mathbf{14}_{2\text{-}3}$ in the direction of arrow E and the cord carrier $\mathbf{20}_2$ as well as the attached rings $\mathbf{14}_{4\text{-}5}$ in the direction of arrow F. Because the rings $\mathbf{14}_{1\text{-}3\ and\ 4\text{-}6}$ are interconnected via the hanging objects 50 (FIG. 3), the rings $\mathbf{14}_{0\text{-}6}$ are pulled behind the rings $\mathbf{14}_{2\text{-}3\ and\ 4\text{-}5}$ into a closed position.

Notably, the positioning of the cord carriers 20 may be dependent upon a manner in which a user desires to manipulate the hanging object or objects 50. For example, while FIG. 1 shows the cord carriers $\mathbf{20}_{1,\,2}$ arranged to move two of the hanging objects 50 in opposite directions to and from a midpoint of the tube 12, the traverse rod assembly 10 contemplates several other alternatives. For instance, a single cord carrier 20 could be positioned to traverse the entire length, L, of the tube 12 to draw a single hanging object 50 open and closed across the span of the tube 12. In another example, several cord carriers $\mathbf{20}_{1\text{-}n}$ may be positioned such that they traverse the length, L, of the tube 12 in the same direction in order to provide adequate force to move a particularly heavy hanging object 50. That is, the number and position of the cord carriers 20 may depend on the number of the hanging objects 50, the weight of the hanging objects 50, a manner in which the user desires the hanging objects 50 to open and close, and so on.

End caps 30 may fit within each of the first and second ends 11, 13 of the tube 12. The end caps 30 may be friction fit into the ends 11, 13 of the tube 12 or they may be secured within the first and second ends 11, 13 of the tube 12 using any number of appropriate fasteners (e.g., threaded screws, rivets, pins, etc.). In one embodiment, decorative finials 32 may be attached to the end caps 30 to provide additional adornment to the traverse rod system 10. Alternatively, the end caps 30 and the decorative finials 32 may be combined in a decorative end cap 30 such that the finials 32 are not attached separately.

In one embodiment shown in FIG. 2, each of the end caps 30 may be secured within the tube 12 using a set screw 54. Specifically, FIG. 2 shows that the set screw 54 may secure the end cap 30 within the end 11 of the tube 12. The set screw 54 protrudes from the tube 12 such that it prevents the end-most ring $\mathbf{14}_0$ from moving toward the center of the tube 12. In this regard, the set screw 54 provides dual functions in that it secures the end cap 30 within the tube 12 and retains the end-most ring $\mathbf{14}_0$ at the end 11 of the tube 12 such the ring $\mathbf{14}_0$ tensions the hanging object (FIG. 3) when the carrier 20 moves away from the ring $\mathbf{14}_0$ toward the midpoint of the tube 12.

In further detail, FIG. 2 shows a cross-sectional view of select components of the traverse rod system 10, including one embodiment of the cord carriers 20. In this embodiment, the cord carriers 20 may be formed of a flat bar of any appropriate metal (e.g., steel or aluminum) or plastic, and the cord carriers 20 may be attached to the rings 14 in any appropriate manner, such as through a welded joint. Each of the cord carriers 20 may include an upwardly protruding column 60 situated between two cord apertures 62. To secure the cord 18, the cord 18 may be wound through the apertures 62 and behind the protruding column, as shown in FIG. 2.

Figure 4:
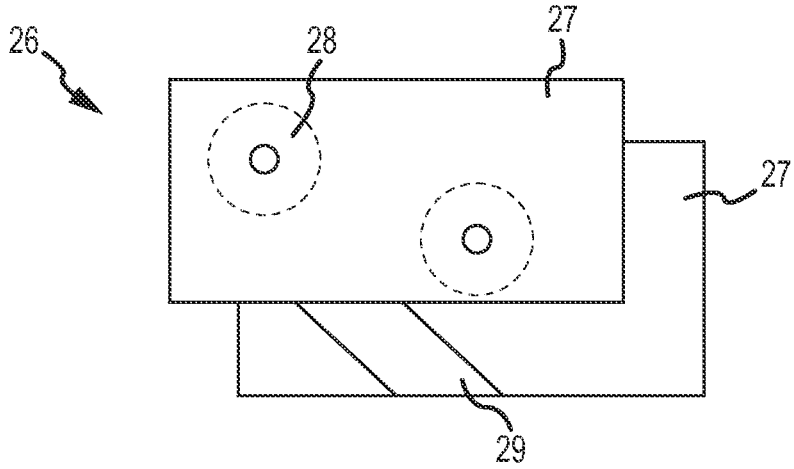
FIG. 4 shows a side perspective view of one embodiment of a pulley housing for use in the traverse rod system of FIG. 1.
Figure 5:
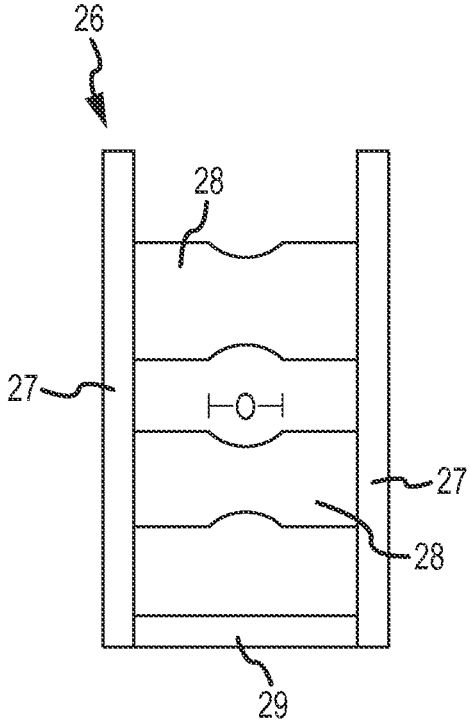
FIG. 5 shows a front view of the pulley housing of FIG. 4 with two roller bearings attached thereto.

To suspend or tension the cord between the first and second ends 11, 13 of the tube 12 such that the user may manipulate the cord carriers 20 by moving the cord 18, a pulley housing 26 may be positioned at each of the first and second ends 11, 13 of the tube 12, as shown in FIG. 1. In one embodiment of the pulley housing 26 shown in FIGS. 4-5, the pulley housing 26 may be a folded metal structure having two parallel sides 27. The parallel sides 27 may be connected through a base 29, which may be affixed to the tube 12 in any appropriate manner. For instance, the base 29 of the housing 26 may be attached to the tube 12 via one or more fasteners (e.g., threaded screws, rivets, pins, etc.) or an adhesive.

The pulley housing 26 may include two roller bearings 28, each spanning a distance between the parallel sides 27 of the pulley housing 26. The roller bearings 28 may be affixed between the parallel sides 27 of the pulley housing 26 in any appropriate manner, including, for instance, using a press fit or any appropriate fastener or fasteners (e.g., threaded screws, rivets, pins, etc.). Each of the roller bearings 28 may be configured to accommodate a diameter, D, of the cord 18 (e.g., ⅛ inch) such that the cord 18 may be positioned about the roller bearings 28 at each of the first and second ends 11, 13 of the tube 12, as shown in FIGS. 1-2.

FIG. 3 shows an end view of select components of one embodiment of the traverse rod system 10, as mounted to a surface 52 through a bracket 34. In this embodiment, the traverse rod system 10 is supporting a hanging object 50. The bracket 34 may be a standard bracket that is configured to receive and cradle the tube 12 and support the collective weight of the traverse rod system 10 and the hanging object or objects 50. The bracket 34 may be a commercially purchased bracket formed of any appropriate material (e.g., steel, aluminum, plastic). Any appropriate number of brackets may be used to mount the traverse rod system 10 at appropriate intervals along the tube 12 depending on the size and/or weight of the traverse rod system 10 and a desired configuration of the hanging object or objects 50 (i.e., how a user wishes the hanging objects 50 to open and close). Notably, certain tube materials (e.g., steel) allow the tube 12 to span a significant distance without buckling or sagging. In these instances, the brackets 34 may be placed only at the first and second ends 11, 13 of the tube 12, thereby simplifying aesthetics as well as reducing the overall time and cost necessary to install the traverse rod system.

While the embodiments of the invention have been illustrated and described in detail in the drawings and foregoing description, such illustration and description is to be considered as exemplary and not restrictive in character. For example, certain embodiments described above may be combinable with other described embodiments and/or arranged in other ways. Accordingly, it should be understood that only example embodiments and variants thereof have been shown and described.

What is claimed:

1. A traverse rod system, comprising: a longitudinally extending tube element, wherein said tube element comprises an opening that extends along an upper length of said tube element; one or more rings at least partially encircling said tube element, each of said rings having an inner annular surface for bearing against upper surface portions of said tube element adjacent said opening; and a cord carrier disposed within an interior of said tube element, wherein said cord carrier secures a portion of a cord, said cord carrier being interconnected to said rings via said opening such that when said cord is operated to move said cord carrier relative to said interior of said tube element, said inner annular surface of each of said rings slides on said upper surface portions of said tube element.

2. A traverse rod system as defined in claim 1, wherein said tube element is hollow.

3. A traverse rod system as defined in claim 1, wherein said tube element comprises a first longitudinal edge bordering a first side of said opening, a second longitudinal edge bordering a second side of said opening, and an edge guard associated with each of said first and second longitudinal edges.

4. A traverse rod system as defined in claim 3, wherein said rings bear upon said edge guards.

5. A traverse rod system as defined in claim 1, wherein each said ring comprises an inner diameter having a low-friction lining.

6. A traverse rod system as defined in claim 1, wherein said tube element has a curvature.

7. A traverse rod system as defined in claim 1, wherein a radius of said curvature is a function of one or more of a diameter of said tube element and a configuration of said cord carrier.

8. A traverse rod system as defined in claim 1, wherein said cord is suspended between pulley mechanisms affixed at each end of said tube element, and wherein each said pulley mechanism comprises one or more roller bearings operably coupled to a pulley housing.

9. A traverse rod system as defined in claim 1, further comprising an object carrier fixably coupled to said rings, wherein said object carrier is configured to engage a hanging object such that when said rings traverse said exterior of said tube element, said object carrier and said hanging object traverse said exterior of said tube element.

10. A traverse rod system as defined in claim 9, wherein said hanging object comprises a curtain, a drape, a window covering, a wall covering, or a tapestry.

11. A traverse rod system, comprising: a longitudinally extending tube element having a tube exterior and a hollow tube interior, wherein said tube element comprises an opening that extends along an upper length of said tube element; a first ring at least partially encircling said tube element, wherein inner annular surface portions of said first ring rest upon a bearing surface of said tube exterior adjacent said opening; a cord suspended within said hollow tube interior, said cord having a first portion and a second portion; and a first cord carrier fixably coupled to said first ring at said opening and extending into said hollow tube interior, wherein said first cord carrier secures said first portion of said cord, and wherein when said first portion of said cord is operated to move said first cord carrier in a first direction relative to said tube interior, said inner annular surface portions of said first ring slide on said bearing surface said tube exterior in said first direction.

12. A traverse rod system as defined in claim 11, wherein said tube element comprises a first longitudinal edge bordering a first side of said opening and a second longitudinal edge bordering a second side of said opening, and wherein said first and second longitudinal edges form said bearing surface of said tube exterior.

13. A traverse rod system as defined in claim 11, wherein said tube element comprises a first longitudinal edge bordering a first side of said opening, a second longitudinal edge bordering a second side of said opening, and one or more edge guards that envelop each of said first and second longitudinal edges.

14. A traverse rod system as defined in claim 11, wherein said first ring comprises an inner diameter having a low-friction lining.

15. A traverse rod system as defined in claim 11, wherein said first cord carrier is freely suspended from said first ring into said hollow tube interior.

16. A traverse rod system as defined in claim 11, wherein said tube element has a curvature.

17. A traverse rod system as defined in claim 11, wherein said cord is suspended between a first pulley mechanism affixed at a first end of said hollow tube interior and a second pulley mechanism affixed at a second end of said hollow tube interior, wherein said first and second pulley mechanisms are configured such that when said first portion of said cord moves in said first direction relative to said tube interior, said second portion of said cord moves in a second direction relative to said tube interior.

18. A traverse rod system as defined in claim 17, wherein said second direction is opposite said first direction.

19. A traverse rod system as defined in claim 17, wherein each of said first and second pulley mechanisms comprises one or more roller bearings operably coupled to a pulley housing.

20. A traverse rod system as defined in claim 17, further comprising: a second ring at least partially encircling said tube element, wherein said second ring rests upon said bearing surface of said tube exterior; a second cord carrier fixably coupled to said second ring and extending into said hollow tube interior, wherein said second cord carrier secures said second portion of said cord, and wherein when said first portion of said cord moves in said first direction, said second ring traverses said tube exterior in said second direction; and first and second object carriers fixably coupled to said first and second rings, wherein said first and second object carriers are configured to engage first and second hanging objects such that when said first portion of said cord moves in said first direction, said first and second hanging objects move in said first and second directions, respectively.

21. A traverse rod system as defined in claim 20, wherein said first object carrier comprises a first overlap arm and said second object carrier comprises a second overlap arm, and wherein said first and second overlap arms are configured to overlap when said first and second cord carriers are positioned at an approximate midpoint along said tube element.

22. A traverse system for manipulating hanging objects, comprising: a rod, wherein said rod comprises first and second end portions bordering a longitudinally extending center portion, said rod having an inner annular wall that is uniformly offset from an outer annular wall and an opening extending along an upper length of said rod, wherein said outer annular wall comprises a bearing surface; one or more rings at least partially encircling said rod, each of said rings having an inner annular surface for bearing against said bearing surface of said rod; a cord carrier coupled with said rings and extending into an interior of said rod; and a cord that is longitudinally suspended within said interior of said rod, wherein said cord is fixably attached to said cord carrier such that moving said cord relative to said rod causes said inner annular surface of each of said rings to slide on said bearing surface of said rod, and wherein other than said cord carrier and said cord, said interior of said longitudinally extending center portion of said rod is substantially free of structure relating to said traverse system.

23. A traverse system as defined in claim 22, wherein said rod has first and second edges bordering said opening, and wherein said bearing surface comprises one or more edge guards that envelop each of said first and second edges.

24. A traverse system as defined in claim 22, wherein said cord carrier has a top end and a bottom end, and wherein said top end of said cord carrier fixably attaches to said rings and said bottom end of said cord carrier extends through said opening into the interior of said rod.

* * * * *